US011808073B2

(12) United States Patent
Hollermann

(10) Patent No.: US 11,808,073 B2
(45) Date of Patent: Nov. 7, 2023

(54) SELF SEATING FENESTRATION HARDWARE

(71) Applicant: Marvin Lumber and Cedar Company, LLC, Eagan, MN (US)

(72) Inventor: Ross Michael Hollermann, Salol, MN (US)

(73) Assignee: Marvin Lumber and Cedar Company, LLC, Warroad, MN (US)

( * ) Notice: Subject to any disclaimer, the term of this patent is extended or adjusted under 35 U.S.C. 154(b) by 196 days.

(21) Appl. No.: 16/793,684

(22) Filed: Feb. 18, 2020

(65) Prior Publication Data

US 2020/0263475 A1 Aug. 20, 2020

Related U.S. Application Data

(60) Provisional application No. 62/807,155, filed on Feb. 18, 2019.

(51) Int. Cl.
*E05F 11/02* (2006.01)
*E05F 11/10* (2006.01)

(52) U.S. Cl.
CPC ..... *E05F 11/02* (2013.01); *E05F 11/10* (2013.01)

(58) Field of Classification Search
CPC . E05F 11/02; E05F 11/16; E05F 11/10; E05F 11/32; E05F 11/14; Y10S 16/90; Y10S 16/473; Y10S 292/12; Y10S 292/57
See application file for complete search history.

(56) References Cited

U.S. PATENT DOCUMENTS 3,270,536 A 9/1966 Abraham
4,305,228 A * 12/1981 Nelson ..... E05D 15/30 49/252
4,937,976 A 7/1990 Tucker et al.
(Continued)

FOREIGN PATENT DOCUMENTS

CA 2087309 C 8/1999

OTHER PUBLICATIONS

"U.S. Appl. No. 29/726,492, Notice of Allowance dated May 6, 2020", 8 pgs.

(Continued)

*Primary Examiner* — Justin B Rephann
(74) *Attorney, Agent, or Firm* — Schwegman Lundberg & Woessner, P.A.

(57) ABSTRACT

A fenestration assembly includes an operator assembly having an escutcheon configured for coupling with the fenestration assembly. A handle linkage is coupled with the escutcheon and rotatable relative to the escutcheon. The handle linkage includes a handle arm rotatably coupled with the escutcheon and a handle knob rotatably coupled with the handle arm. An articulating joint is between the handle arm and the handle knob. The handle linkage is movable between stowed and operational configurations. In the stowed configuration the handle linkage is seated along the escutcheon, and the handle arm and the handle knob are aligned. In the operational configuration the handle linkage is unseated from the escutcheon, the handle knob and the handle arm are misaligned with the handle knob at an operating angle relative to the handle arm, and the handle linkage is configured to open and close a fenestration panel.

23 Claims, 7 Drawing Sheets

(56) References Cited

U.S. PATENT DOCUMENTS

| | | | | |
|---|---|---|---|---|
| 5,400,473 | A * | 3/1995 | Delman | E05F 11/16 16/429 |
| D435,429 | S | 12/2000 | Barnett et al. | |
| 6,672,010 | B1 * | 1/2004 | Gledhill | E05F 11/34 49/339 |
| D497,304 | S | 10/2004 | Stoll et al. | |
| D522,837 | S | 6/2006 | Vetter et al. | |
| 7,066,505 | B2 * | 6/2006 | Van Klompenburg | E05C 9/02 292/336.3 |
| 7,147,256 | B2 * | 12/2006 | Gill | E05F 11/16 292/336.3 |
| 7,251,860 | B2 * | 8/2007 | Liang | E05F 11/00 16/426 |
| D591,146 | S | 4/2009 | Dallmann et al. | |
| D595,110 | S | 6/2009 | Berstler et al. | |
| D595,111 | S | 6/2009 | Jones et al. | |
| 9,003,706 | B2 * | 4/2015 | Meves | E05F 11/34 49/246 |
| 9,404,288 | B2 | 8/2016 | Curtis et al. | |
| D780,555 | S | 3/2017 | Vetter | |
| D818,798 | S | 5/2018 | Black et al. | |
| D819,425 | S | 6/2018 | Black et al. | |
| D844,412 | S | 4/2019 | Von Holzhausen et al. | |
| 10,294,714 | B2 | 5/2019 | Massey | |
| D874,901 | S | 2/2020 | Vetter et al. | |
| D895,414 | S | 9/2020 | Woodward et al. | |
| 10,760,317 | B2 * | 9/2020 | Guelck | E05C 17/24 |
| 2004/0183314 | A1 * | 9/2004 | Klompenburg | E05C 9/02 292/263 |
| 2004/0216381 | A1 * | 11/2004 | Clavet | E05F 11/10 49/342 |
| 2005/0212305 | A1 * | 9/2005 | Gill | E05F 11/16 292/336.3 |
| 2007/0289100 | A1 * | 12/2007 | Lake | E05D 15/30 16/362 |
| 2008/0066382 | A1 * | 3/2008 | Erickson | E05B 1/0092 49/246 |
| 2008/0256868 | A1 * | 10/2008 | Heppner | E05F 11/16 49/324 |
| 2013/0312331 | A1 * | 11/2013 | Bourgoin | E05F 11/10 49/359 |
| 2014/0259940 | A1 * | 9/2014 | Meves | E05F 11/32 49/350 |
| 2017/0107750 | A1 * | 4/2017 | Carrier | E05C 9/041 |
| 2019/0383069 | A1 * | 12/2019 | Guelck | E05D 15/30 |

OTHER PUBLICATIONS

"Canadian Application Serial No. 194040, Response Filed May 19, 2022 to Canadian Office Action dated Feb. 24, 2022", 2 pgs.

"Canadian Application Serial No. 3,072,805, Office Action dated Dec. 10, 2021", 4 pgs.

"Canadian Application Serial No. 3,072,805, Response Filed Apr. 11, 2022 to Office Action dated Dec. 10, 2021", 15 pgs.

U.S. Appl. No. 29/726,492, filed Mar. 3, 2020, Fenestration Hardware.

* cited by examiner

SELF SEATING FENESTRATION HARDWARE

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Marvin Lumber and Cedar Company (d/b/a Marvin Windows and Doors), Warroad, Minn. All Rights Reserved.

TECHNICAL FIELD

This document pertains generally, but not by way of limitation, to operation hardware for fenestration assemblies.

BACKGROUND

Fenestration assemblies include hardware such as window drive mechanisms to facilitate opening of the window by the operator. Casement windows, awning windows, venting picture windows and the like are examples of fenestration assemblies with hardware used to open a panel, such as a sash (and similarly a door). The panel of the fenestration assembly rotates from a closed position to an open position with respect to the fenestration frame. The hardware includes a user input, such as a crank, that actuates a hardware mechanism to move the window between the open and closed positions. In some examples, the hardware is coupled along the sill of the window assembly for access by the operator.

In some examples, the crank is removed from the remainder of the hardware when not in use. For instance, the crank is left on a sill of the fenestration assembly, stored in a drawer or the like. In other examples, the crank remains coupled with the remainder of the hardware and is used for future opening or closing of the fenestration panel.

Overview

The present inventors have recognized, among other things, that a problem to be solved can include minimizing large profiles of hardware used with fenestration assemblies including windows and doors. In some examples, hardware extends significantly beyond the profile of the fenestration frame and protrudes away from fenestration assembly. For example, the hardware extends away from the fenestration frame to provide clearance for the handle and knob configuration used to actuate the operator mechanism, for instance like a crank. The protruding hardware interferes with window treatments, like drapes, curtains, shades or the like. Additionally, the installed hardware extends away from the frame during shipping, is damaged during shipping, and in some examples causes damage to adjacent fenestration assemblies (including glass panes) stored against the hardware. Further, because the hardware is prominently placed along the window frame (e.g., proximate the middle of the sill) the hardware detracts from the appearance of the rest of the window including finished wood, painted sills, panels or the like, and in some examples extends into the daylight opening of the fenestration assembly. In another example, the hardware interrupts the finished appearance of the window frame and provides an unappealing distraction from a minimized and sleek aesthetic.

The present subject matter provides a solution to this problem, with operator assemblies including configurable components that minimize the operator assembly profile while maintaining or even enhancing the functionality of the assembly relative to previous hardware. The operator assemblies described herein include an escutcheon and a handle linkage coupled with the escutcheon. The handle linkage includes a handle arm rotatably coupled with the escutcheon, and a handle knob coupled with the handle arm by way of an articulating joint. The handle linkage is configurable between at least stowed and operational configures through manipulation of the handle linkage. For instance, one or more of articulating at the articulating joint and seating of the handle linkage along the escutcheon facilitate compact storage of the handle linkage. The handle linkage, in the stowed configuration, assumes a handle linkage profile similar to the profiles of the escutcheon and the underlying fenestration assembly (e.g., elongate, having a planar contour or the like). The stowed configuration of the handle linkage with the handle knob and the handle arm aligned minimizes bends, elbows or the like in other hardware that enlarges the hardware profile and frustrates low profile stowing of the hardware. Instead, the operator assemblies described herein include an operator profile including a seat profile of the escutcheon and a minimized handle linkage profile that corresponds to the seat profile. In an example, each of the operator profile and the seat profile include planar contours that extend along a corresponding planar contour of the fenestration assembly (e.g., the fenestration frame). Accordingly, the operator profile corresponds, and thereby blends, with the fenestration assembly components, such as the fenestration frame.

In another example, articulating of the handle knob into a misaligned configuration with the handle knob at an operating angle relative to the handle arm facilitates operation of the handle linkage to move a fenestration panel (e.g., between opened and closed positions). For example, the handle knob and the handle arm transition from alignment in the stowed configuration to misalignment at the operating angle. The handle knob is rotatable relative to the handle arm while the handle linkage is operated to move the fenestration panel. Accordingly, the handle linkage is used in a manner similar to a crank having an upstanding rotatable handle knob, and is also reconfigurable to the stowed configuration with the handle knob and the handle arm aligned.

In other examples, the operator assemblies described herein include one or more features configured to facilitate the alignment and seating of the handle linkage in the stowed configuration. In one example, guide elements are provided with the handle linkage and the escutcheon. The guide elements (e.g., sockets, grooves, plugs, ridges, bosses or the like) are coupled with each other as the handle linkage transitions from the operational configuration to the stowed configuration. The coupling of the guide elements guides the handle knob and handle arm into alignment while seating the handle linkage along the escutcheon. In one example, the handle linkage self-seats itself along the escutcheon to facilitate stowing of the linkage.

In another example, the operator assemblies described herein, include one or more bias elements including, but not limited to, detents, magnets or the like that guide the handle knob and handle arm into alignment. For instance, the one or more bias elements are positioned away from a linkage pin axis the handle knob rotates around. Rotation of the handle knob and the handle arm toward alignment brings the bias elements into proximity and initiates further bias by the bias elements to complete the alignment. The bias provided by the bias elements resists further rotation of the handle knob away from alignment. Accordingly, even with misalignment of the handle knob and the handle arm as the handle linkage is stored the one or more bias elements guide the components into alignment for seating along the escutcheon (e.g., one example of self-seating).

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIG. 6 is an exploded view of the example handle linkage shown in

FIG. 2.

DETAILED DESCRIPTION

Figure 1:
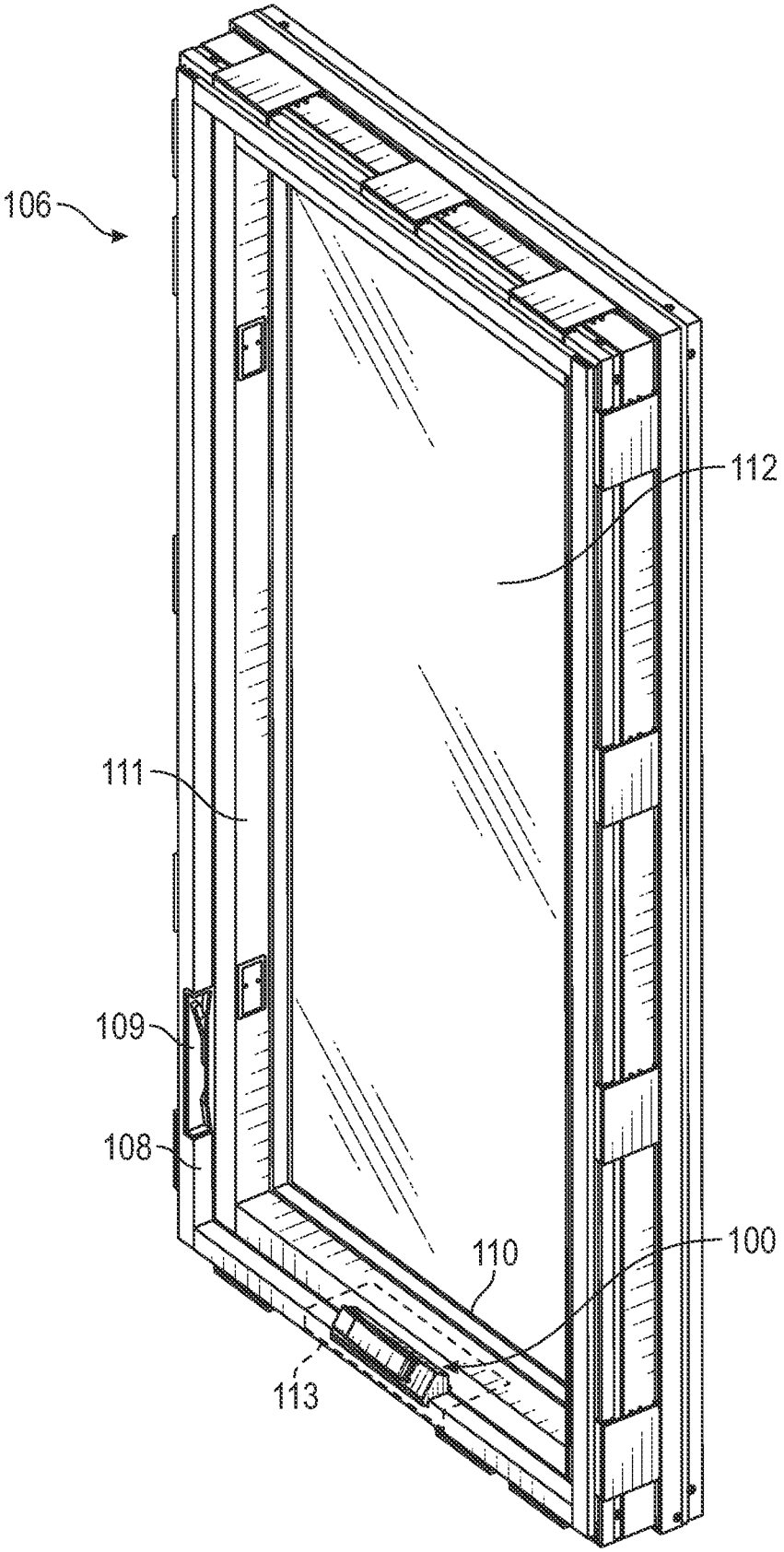
FIG. 1 is a perspective view of a fenestration assembly including an example operator assembly.

FIG. 1 is a perspective view of an example fenestration assembly 106 including an operator assembly 100 configured to move a panel 110, such as a window sash, door panel or the between open and closed positions. The panel 110 optionally includes a glass pane 112 (or interior door panel if a door) and the panel 110 is coupled with a fenestration frame 108 of the assembly 106. As described herein, the operator assembly 100 includes stowed and operating configurations. In the operating configuration portions of the operator assembly 100, such as a handle arm and handle knob, are misaligned to provide a crank for actuation of an operating mechanism between the panel 110 and the fenestration frame 108. In the stowed configuration the portions of the operator assembly 100 are reconfigured, for instance with an intervening articulating joint, to facilitate low profile storage of the handle arm and handle knob along the fenestration assembly 106, for instance with minimal interruption to the overall profile of the assembly 106 (e.g., blending of the hardware with the remainder of the assembly).

Referring again to FIG. 1, the fenestration assembly 106 is shown with the panel 110 in a closed position relative to the fenestration frame 108. Optionally, the fenestration assembly 106 includes a latch assembly 109 that secures and releases the panel 110 to accordingly prevent and permit opening of the assembly 106. In the example shown in FIG. 1, the latch assembly 109 is provided along a jamb of the frame (e.g., a side) and accordingly secures the panel 110 from rotating relative to the fenestration frame 108 in the manner of a casement window, swinging door or the like.

As further shown in FIG. 1, an optional screen assembly 111 is coupled with the fenestration assembly 106. The screen assembly 111 in one example is coupled along the fenestration frame 108. The fenestration frame 108 includes a screen frame socket configured to receive a screen frame of the screen assembly 111 surrounding an interior mesh, wiring or the like. In this example, the screen frame seated within the screen frame socket recesses the screen frame from the daylight opening of the fenestration assembly 106 and thereby maximizes the view and daylight passed through the assembly. In a similar manner, and as described herein, the operator assembly 110 having the minimized profile in at least the stowed configuration is misaligned with the daylight opening of the fenestration assembly to accordingly maximize both the view and passage of daylight through the assembly.

As previously discussed, the operator assembly 100 is operated to actuate an operator mechanism 113 coupled between the panel 110 and the fenestration frame 108. The operator mechanism 113 is shown schematically with dashed lines in FIG. 1 and is concealed by one or more of the operator assembly 100 (e.g., an escutcheon or the like), the fenestration frame 108 and in some examples by the screen assembly 111 (e.g., the frame of the screen assembly). The operator assembly 100 includes one or more gears, sprockets, arms or the like that mechanically connect the fenestration panel 110 with the operator assembly 100. Operation of the operator assembly, including rotational movement in the operating configuration, thereby actuates the operator mechanism and moves the panel 110 relative to the fenestration frame 108 (e.g., between open and closed positions).

Figure 2:
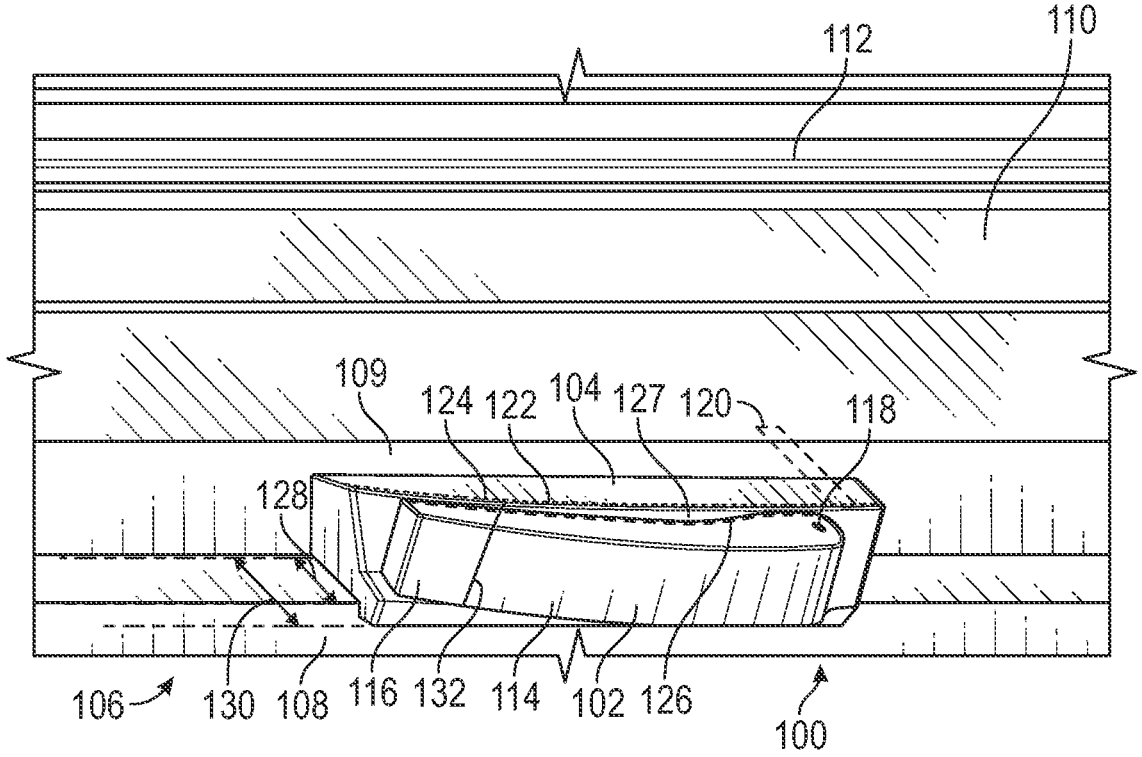
FIG. 2 is a detailed perspective view of a portion of a fenestration assembly including another example of an operator assembly in a stowed configuration.

FIG. 2 is a detailed perspective view of the fenestration assembly 106 of FIG. 1 including portions of the panel 110 and the fenestration frame 108 and the associated operator assembly 100. In this view the panel 110 including the glass pane 112 is in a closed position and seated along the fenestration frame 108. The operator assembly 100 is in the stowed configuration with a handle linkage 102 coupled along an escutcheon 104. The operator assembly 100 includes a corresponding operator profile 130 that is minimized (e.g., relative to a deployed or operating configuration) and blends with the proximate portions of the fenestration frame 108.

The operator assembly 100 includes a handle linkage 102 extending from a handle pivot 118 to a handle knob 116. In the example shown the handle linkage 102 includes a handle arm 114 coupled at the handle pivot 118 with an operator drive shaft 120. In this example, the handle linkage 102 is a two bar type mechanism. In other examples, the handle linkage 102 includes two or more bars (e.g., in the manner of a three bar linkage or the like). The operator drive shaft 120 is in turn coupled with (or a component of) the operator mechanism 113. As further shown in FIG. 2 a portion of the handle arm 114 is coupled with the handle knob 116 at an articulating joint 132. As described herein the articulating joint 132 facilitates articulation of the handle linkage 102 into and between the stowed and operating configurations. For example, in the stowed configuration shown in FIG. 2, the handle linkage 102 is in the stowed configuration and the handle linkage 102 is coupled long the escutcheon 104 to minimize the operator profile 130 of the operator assembly 100. In the operating configuration the articulating joint 132 allows rotation of the handle knob 116 from the aligned configuration shown in FIG. 2 to a misaligned orientation that allows cranking movement of the handle linkage 102 to operate the operator mechanism.

As further shown in FIG. 2, the operator assembly 100 includes an escutcheon 104 having an escutcheon seat 122. The escutcheon is coupled along a proximate frame portion 109 of the fenestration frame 108, for instance extending vertically. Additionally, the escutcheon 104 is coupled with another portion of the fenestration frame 108 in this example extending horizontally and including the fenestration profile 128.

The escutcheon includes the escutcheon seat 122 and the seat includes a seat profile 124 having a seat profile 124 that is complementary to a handle linkage profile 126 of the handle linkage 102 (in the stowed configuration) as shown in FIG. 2. The profiles 124, 126 of the seat and the handle linkage facilitate complementary coupling of these features and minimizing of the overall operator profile 130 to approximate the fenestration profile 128. For example, each of the seat profile 124 and the handle linkage profile 126 provide similar planar contours that facilitate the laying of the handle linkage 102 in a planar orientation along the escutcheon seat 122. Accordingly, the handle linkage 102 in the stowed configuration blends into the escutcheon 104, and the operator assembly 100 including the handle linkage 102 and the escutcheon 104 have a minimal operator profile 130 that blends into the fenestration profile 128. For instance, the seat profile 124 and the handle linkage profile 126 generally extend along the contour of the fenestration frame 108 in contrast to extending away from the frame. In various examples, the operator profile 130 corresponds (e.g., is equal to, approximates or is less than) with the fenestration profile 128 and the projection of the assembly 100 is minimized relative to the overall aesthetic of the fenestration assembly 106 thereby minimizing interruption of the daylight opening, interference with window treatments or the like.

Figure 3:
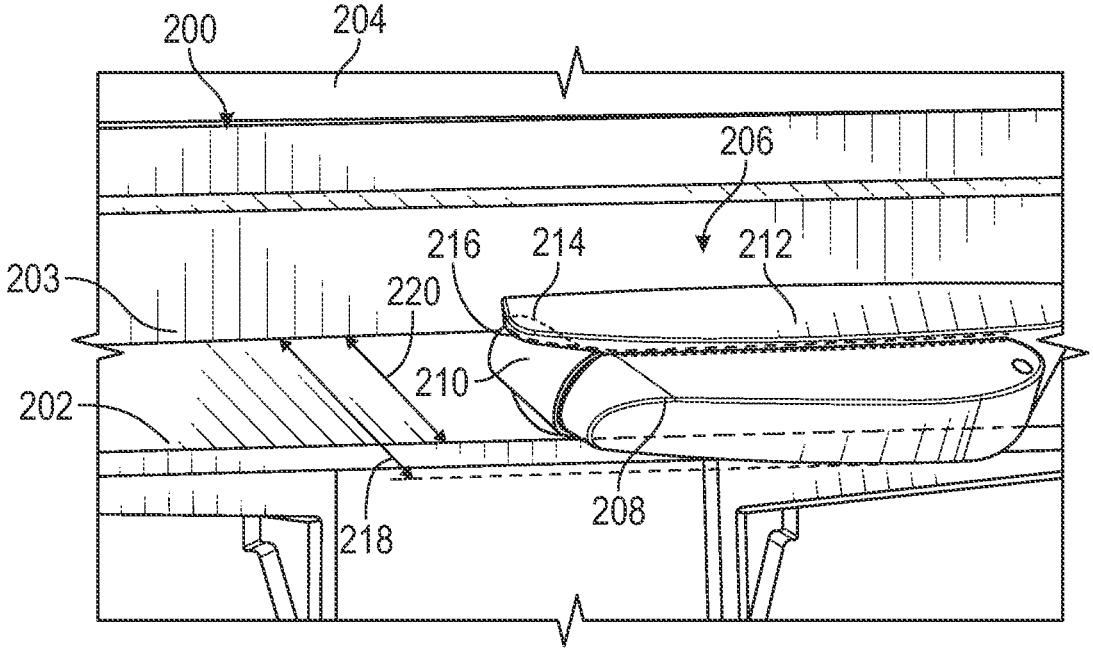
FIG. 3 is a detailed perspective view of an operator assembly projecting from a fenestration frame.

FIG. 3 shows a fenestration assembly 200 having another example of an operator assembly 206. The fenestration assembly 200 includes one or more similar features to the fenestration assembly 106 previous described herein. For instance, the fenestration assembly 200 includes a panel 204, such as a casement, awning, picture sash or the like configured to open with respect to a fenestration frame 202. The operator assembly 206 is coupled along a proximate frame portion 203 of the fenestration frame and includes an operator profile 218 (extending from the frame portion 203) in a similar manner to the fenestration profile 220 of the fenestration frame 202 (e.g., a footprint of the operator assembly 206 is similar to the corresponding adjacent footprint of the fenestration frame 202).

In this example, the operator assembly 206 includes a handle 208 and an angled knob 210. In this example, the angled knob is rotatably coupled with the handle 208. The angled knob 210 does not include one or more of the degrees of freedom present with the operator assembly 100 shown in FIG. 1 that permits aligning and misaligning of handle knob relative to the remainder of the handle. Instead, the angled knob 210 projects at a consistent angle from the handle 208. In a stowed configuration shown in FIG. 2, the handle 208 and the angled knob 210 are both coupled along the escutcheon 212. As shown in FIG. 2 the escutcheon extends from the proximate frame portion 203 and present a projecting escutcheon profile 216 configured to couple with the handle 208 as well as the angled knob 210. Because of the angled knob 210 the escutcheon profile 216 includes additional depth relative to the planar contoured seat profile 124 of the escutcheon 104 shown in FIG. 2 and accordingly the escutcheon extends further from the proximate frame portion 203.

The handle 208 and the angled knob 210 are coupled along the escutcheon 212. For instance an angled handle profile 214 of the handle 208 including the elbow for the angled knob 210 is coupled along the escutcheon profile 216. The angled knob 210 is received within the relatively deeper escutcheon 212 and the operator assembly 206 accordingly projects from the fenestration frame 202 as shown with the operator profile 218 of the assembly 206 relatively pronounced in comparison to the fenestration profile 220 of the fenestration frame. In comparison, the operator profile 130 of the operator assembly 100, including the handle linkage 126 and the complementary escutcheon seat 122 shown in FIG. 2, have a minimized profile proximate to the fenestration profile 128 of the fenestration frame 108. For example, the handle linkage 102 allows for reconfiguring of the handle into the stowed configuration having the handle linkage profile 126 and seat profile 124 (e.g., generally planar contours) with the operator assembly 100 in FIG. 2 that eliminates the depth otherwise used to house the angled knob 210 and the relatively pronounced operator assembly 206 shown in FIG. 3.

Figure 4:
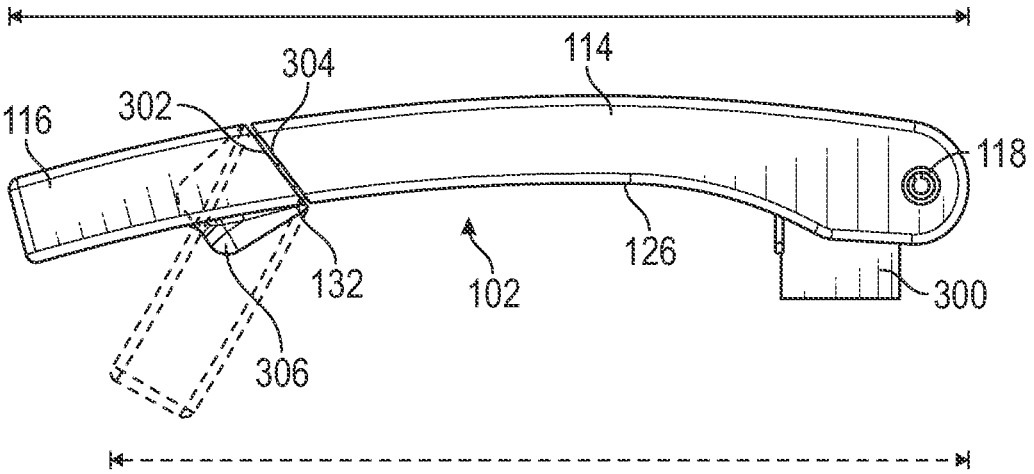
FIG. 4 is a side view of an example handle linkage of the operator assembly shown in FIG. 2.

FIG. 4 is a side view of an example of the handle linkage 102. As shown the handle linkage includes the handle arm 114 extending from a handle pivot 118 and an associated drive socket 300 to an arm interface 304 and the articulating joint 132. The handle knob 116 is movably coupled with the handle arm 114 at the articulating joint 132. For example, the knob interface 302 of the handle knob 116 is optionally in surface to surface contact with the arm interface 304 of the handle arm 114. As described herein, movement of the handle knob 116 relative to the handle arm 114 at the articulating joint reconfigures the handle linkage 102 from the stowed configuration shown in FIG. 4 to an operating configuration that permits rotation of the handle linkage 102 in the manner of a crank.

As shown in FIG. 4, the handle linkage 102 includes a gently curved shape that is similarly included with the escutcheon 104 along the seat profile 124 of the escutcheon seat 122. The complementary shaped surfaces facilitate the seating of the linkage 102 along the escutcheon seat 122. As shown in FIG. 2, and previously described herein, the planar contour of the handle linkage profile 126 (in the stowed configuration) blends the handle linkage 102 with the fenestration frame 108 and accordingly minimizes the profile of the operator assembly 100 relative to other, larger profile, assemblies like that shown in FIG. 3. Additionally, the planar contour of the handle linkage profile 126 interfits with the corresponding seat profile 124 of the escutcheon 104 and guides the linkage 102 into complementary coupling along the seat profile 124. In an example including the handle knob 116 or handle arm 114 misaligned with each other or misaligned with the seat profile 124, the complementary shaped seat profile 124 and the handle linkage profile 126 cooperate to guide further rotation of the handle knob 116, movement of the handle arm 114 or the like into the stowed configuration as the handle linkage 102 seats along the seat profile 124. For instance, the components of the operator assembly 100 cooperate to self-seat the handle linkage 102 along the escutcheon 104 with the linkage aligned relative to an operating configuration (see FIGS. 10A-10D).

The handle linkage 102 in the example shown optionally includes a linkage guide 306 configured to guide alignment of the handle knob 116 with the handle arm 114 in the stowed configuration. In one example, the linkage guide is a socket, fitting or the like that cooperates with a complementary shaped feature of the escutcheon 104, such as the guide socket 400 shown in FIG. 5. In operation the handle knob 116 is aligned as shown in FIG. 4 with the handle arm 114 and the handle linkage 102 is coupled along the escutcheon seat 122. In one example, if the handle knob 116 is not fully aligned with the handle arm 114 the linkage guide 306 is seated partially within the corresponding feature of the guide socket 400. The partial seating of the linkage guide 306 biases the handle knob 116 toward the stowed configuration. As the linkage guide 306 is funneled into seating along the guide socket 400 the handle knob 116 further rotates correspondingly into the aligned orientation shown in FIG. 4. Accordingly, even with misalignment the operator assembly 100 including the handle linkage 102 and the escutcheon 104 self-seats (e.g., guides and aligns) the linkage to the stowed configuration shown in FIG. 2.

As further shown in FIG. 4, the arm interface 304 and the knob interface 302 at the articulating joint 132 are at complementary angles and accordingly the interfaces are in surface to surface contact. Additionally, the interfaces 304, 302 guide rotation of the handle knob 116 relative to the handle arm 114 into an operating configuration shown by way of examples in FIGS. 10A-10D. For instance, rotation of the handle knob into a misaligned orientation relative to the handle arm 114 is guided with the interfaces 304, 302 and positions the handle knob 116 in relatively upright orientation to facilitate cranking movement of the handle linkage 102.

Figure 5:
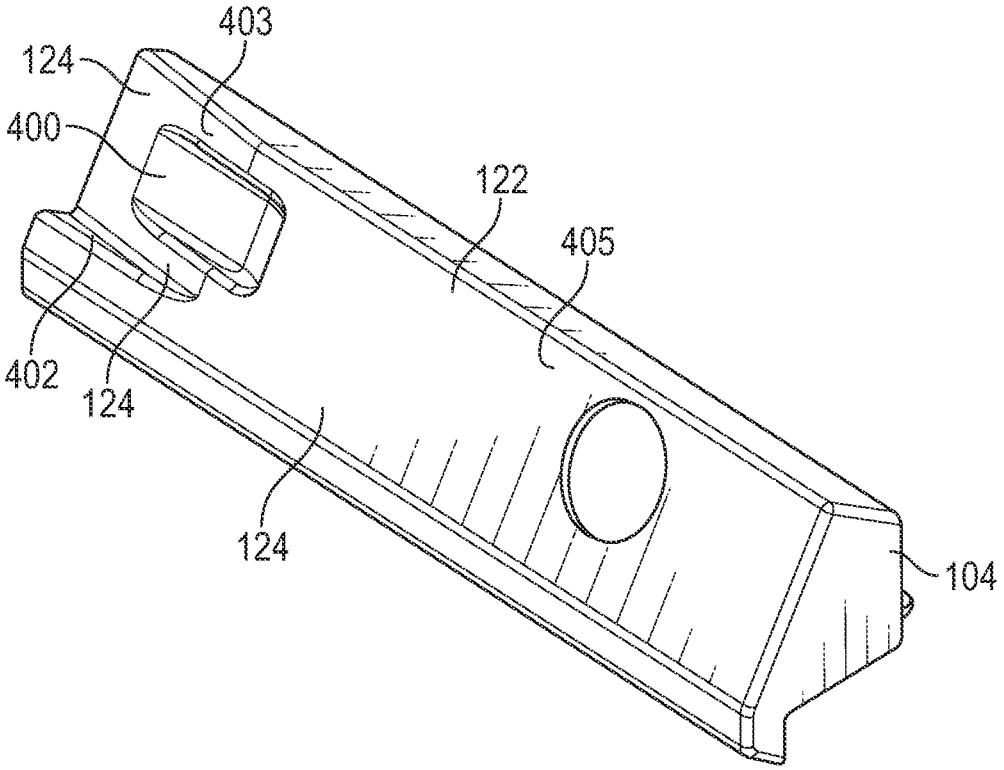
FIG. 5 is a perspective view of an example escutcheon of the operator assembly shown in FIG. 2.

FIG. 5 is a perspective view of the escutcheon 104 including the escutcheon seat 122 having the seat profile 124 complementary to the handle linkage profile 126 shown in FIG. 4. In the example shown, the escutcheon 104 includes a handle shelf 402 extending from the remainder of the escutcheon 104. The handle shelf 402 supports the handle linkage, such as the handle knob 116, while the linkage 102 is coupled along the escutcheon 104 and facilitates maintaining the handle linkage 102 along the escutcheon when not in use.

The seat profile 124, as shown in FIG. 5 optionally includes one or more portions. As shown a first portion 403 having a complementary surface to at least the handle knob 116, and optionally a portion of the handle arm 114. The portion of the handle linkage profile 126 is readily seated in surface to surface contact with the handle knob 116 while the handle linkage 102 is stored. Optionally, misaligned coupling (e.g., tilting) of the handle knob 116 with the complementary first portion 403 guides or biases the handle knob 116 into surface to surface coupling along the seat profile 124. Additionally, if the handle knob 116 is misaligned with the handle arm 114, guidance or bias provided by the first portion 403 facilitates alignment between the components into the stowed configuration shown in FIG. 4. Accordingly, the coupling of the operator assembly 100 components during stowing self-seats the handle linkage 102. An optional second portion 405 of the seat profile 124 is shown in FIG. 5. In one example, the second portion 405 has a similar profile to the corresponding portion of the handle linkage profile 126. In another example, the second portion 405 has less curvature than the handle arm 114. As shown in FIG. 2, the variation in curvature provides a recess 127 between the handle linkage 102 and the escutcheon 104 to facilitate grasping of the handle linkage 102 (e.g., as a finger pull) and movement of the linkage 102 from the stowed configuration to an operating configuration.

An example guide socket 400 is provided with the escutcheon 104. In this example, the guide socket 400 includes a recess having a complementary profile to the linkage guide 306 shown in FIG. 3. The guide socket 400 and the linkage guide 306 cooperate to seat the handle linkage 102 in the stowed configuration along the escutcheon 104. Additionally, the guide socket 400 and the linkage guide 306 cooperate to bias the handle linkage 102 into a seated positioned along the escutcheon 104, and in other examples bias components of the linkage 102 into alignment with each other, for instance into the stowed configuration shown in FIG. 4.

In another example, the handle shelf 402 cooperates with the guide socket 400 and the seat profile 124 to securely retain the handle linkage 102 along the escutcheon when not in use. For instance, each of the handle shelf 402, guide socket 400 and the seat profile 124 are correspondingly fit with opposed components of the handle linkage 102, including one or more of the edge of the handle linkage 102 (for the handle shelf), the linkage guide 306 (for the guide socket) and the handle linkage profile 126 (for the seat profile 124).

As further shown in FIG. 5, the escutcheon 104 has a relatively shallow profile in comparison to the escutcheon 212 shown in FIG. 4. The escutcheon 212 has a deeper profile to received the angled knob 210 extending at an angle to the remainder of the handle 208. In contrast, the escutcheon 104 shown in FIG. 5 has a relatively shallow profile that interfits with the aligned components of the correspondingly shallow handle linkage 102 when in the stowed configuration.

Figure 6:
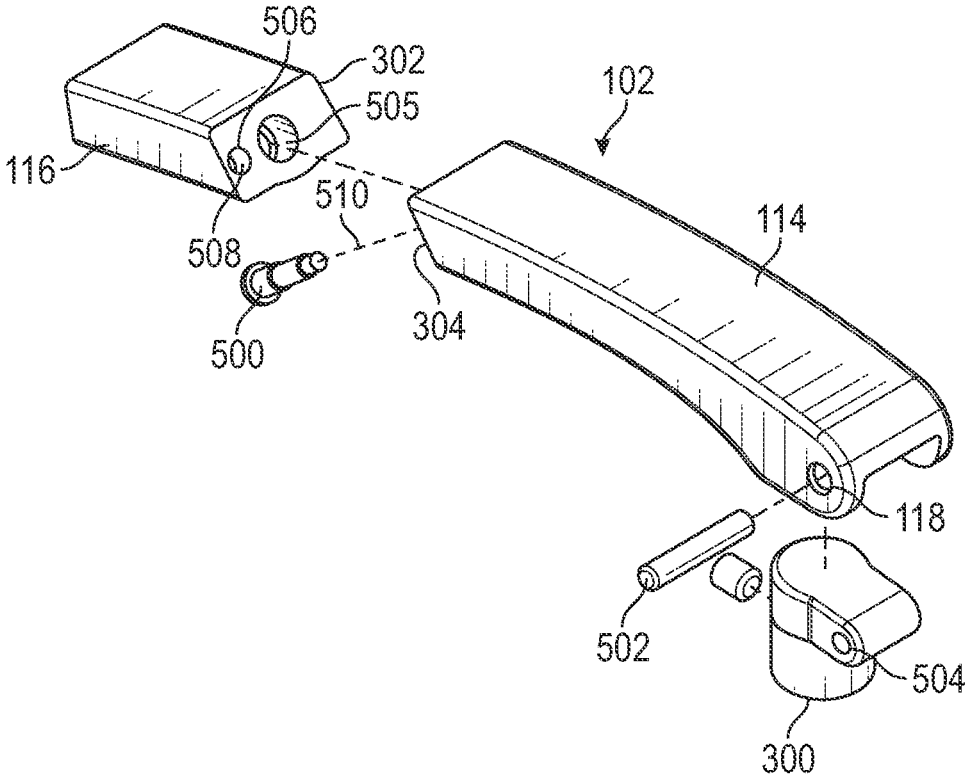

FIG. 6 is an exploded view of the handle linkage 102. The handle knob 116 is decoupled from the handle arm 114, and the knob interface 302 is spaced from the arm interface 304 of the handle arm 114. A pin recess 505 is provided in the handle knob 116 for reception of a linkage pin 500. The linkage pin 500 rotatably couples the handle knob 116 with the handle arm 114 when assembled at the articulating joint 132 (disassembled in FIG. 6).

When assembled the arm and knob interfaces 304, 302 are coupled with each other, and the linkage pin 500 facilitates rotation of the handle knob 116 relative to the handle arm 114, for instance to transition the handle linkage 102 from the stowed configuration (shown with a solid line length dimension in FIG. 4) to the operating configuration (shown with a dashed line length dimension in FIG. 4), and to rotate the handle knob 116 relative to the handle arm 114 during opening and closing actuation of the handle linkage 112. The linkage pin 500 is provided at an angle, for example along a linkage pin axis 510 transverse (e.g., crossing) to the handle linkage 102 (the handle arm 114) in the stowed configuration. Additionally, the knob and arm interfaces 302, 304 are at angles and cooperate with the linkage pin 500 to guide movement of the handle knob 116 from an aligned orientation in the stowed configuration to the angled orientation in the operating configuration. Further, the linkage pin axis 510 remains transverse to the handle arm 114 (is static) during opening and closing actuation of the handle linkage, and accordingly guides rotation of the handle knob 116 relative to the handle arm 114.

Figure 7A:
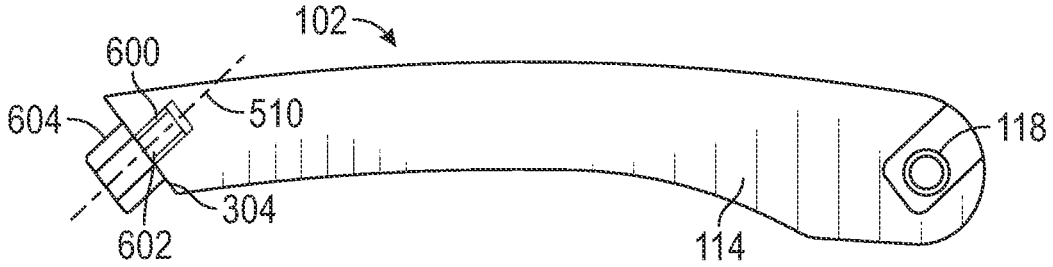
FIG. 7A is a side view of an example handle arm of the handle linkage shown in FIG. 2.

In one example, one or more bias elements 508 are provided proximate to the articulating joint 132 and the associated interfaces 302, 304. The bias elements 508 retain the handle knob 116 in the stowed configuration until force is applied (e.g., by an operator hand or fingers) to move the knob into a misaligned configuration with the handle arm 114, for instance during operation of the operator assembly 100. Optionally, the bias element 508 of the handle knob 116 cooperates with one or more bias elements 602 associated with the handle arm 114 (an example is shown in FIGS. 7A, B). The bias element 508 includes, but is not limited to, one or more of a detent, magnet or the like. In the example shown in FIG. 6, the bias element 508 is installed within a corresponding bias element recess 506 provided in the handle knob 116.

Referring again to FIG. 6, the handle arm 114 is shown decoupled from the drive socket 300. In this example, the handle arm 114 includes a pivot pin 502 that extends through the handle arm 114 and rotatably couples the arm with the drive socket 300 at a pivot base 504. The handle arm 114 rotates at the pivot base 504, for instance from the stowed configuration to the operating configuration (e.g., shown in FIGS. 10A-10D).

FIGS. 7A, B are respective side and bottom views of the handle arm 114. As previously described the handle arm 114 extends between the handle pivot 118 configured for coupling with a drive socket 300 and the arm interface 304 of the articulating joint 132 (see FIG. 4). The drive socket 300 includes the operator drive shaft 120 of the operator mechanism 113 (see FIGS. 1 and 2), and in another example, the drive socket 300 is coupled with the operator drive shaft 120. Rotating of the handle arm 114 and the associated handle linkage 102 actuates the operator mechanism 113, and accordingly moves the panel of the fenestration assembly between open and closed positions.

Figure 7B:
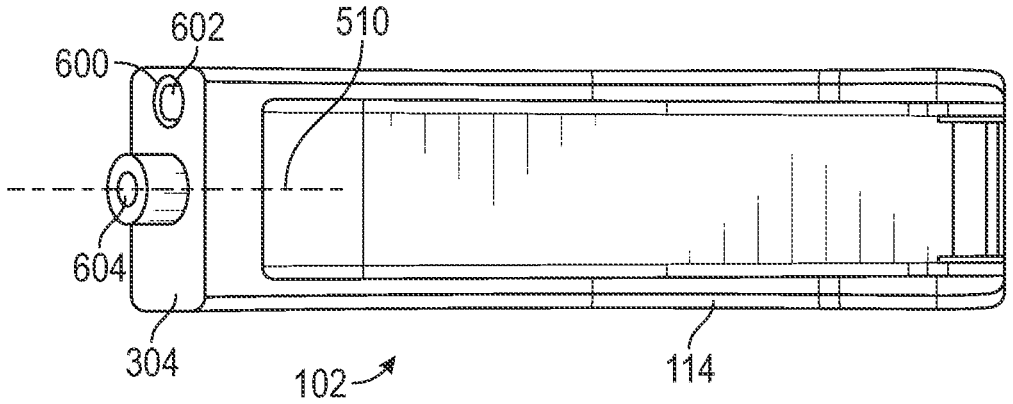
FIG. 7B is a bottom view of the example handle arm of the handle linkage shown in FIG. 2.

As shown in FIG. 7B, the handle arm 114 includes a pin socket 604 configured for reception of the linkage pin 500 shown in FIG. 6. The linkage pin 500 and the pin socket 604 provide a rotatable coupling with the handle knob 116 at the articulating joint 132. As shown in FIGS. 7A, B, the pin socket 604 is aligned with the linkage pin axis 510, and the linkage pin axis 510 is transverse (at an angle) to the handle arm extending between the arm interface 304 and the handle pivot 118. The linkage pin axis 510 is the rotation axis for the handle knob 116 with respect to the handle arm 114. As described herein, and shown in FIGS. 10A-10D the rotation of the handle knob 116 along the linkage pin axis 510 and optionally further guided by the arm interface 304 and the knob interface 302 guides the rotation of the handle knob 116 into an angled position (from the aligned stowed configuration) for use of the handle linkage 102 as a crank in the operating configuration.

As further shown in FIG. 7B, the handle arm 114 in this example includes a bias element 602, for instance provided in a corresponding bias element recess 600. The bias element 602, in a similar manner to the bias element 508 of the handle knob 116, guides alignment of the handle knob 116 with the handle arm 114, for instance toward the stowed configuration. Accordingly, as the handle linkage 102 is coupled along the escutcheon 104 the bias element (either or both of 602 and 508) biases the handle knob 116 toward alignment with the handle arm 114 and accordingly minimizes (e.g., reduces or eliminates) misalignment of the handle linkage when seated along the escutcheon 104. The one or more bias elements 602, 508 thereby enhance the self-seating operation of the handle linkage 114 into the stowed configuration.

The bias element 602 retains the handle knob 116 in the stowed configuration until force is applied (e.g., by an operator hand or fingers) to move the knob into a misaligned configuration with the handle arm 114, for instance during operation of the operator assembly 100. Optionally, the bias element 602 cooperates with the bias element 508 of the handle knob 116 to maintain the handle linkage 102 in the aligned orientation of the stowed configuration or to assist with biasing the handle knob 116 toward the aligned orientation.

The bias elements 508, 602 include, but are not limited to, one or more of a detent, magnet or the like. In the example shown in FIG. 7B, the bias element 602 is installed within a corresponding bias element recess 600 provided in the handle arm 114. In one example, the bias element (either of 508, 602) is a deflectable detent (e.g., a ball detent) that is received in the opposed recess (506, 600) of the opposed linkage component, either of the handle knob 116 or the handle arm 114. Movement of the detent into the opposed recess guides the handle linkage 102 into alignment for the stowed configuration, and reception of the detent in the recess maintains the alignment.

In another example, the bias element 508, 602 includes a magnet and the opposed bias element 602, 508 includes a ferrous insert or the like. The magnet and ferrous insert cooperate to guide the handle linkage 102 into the aligned orientation and retain the linkage in the aligned orientation of the stowed configuration until actuation by a user.

Figure 8A:
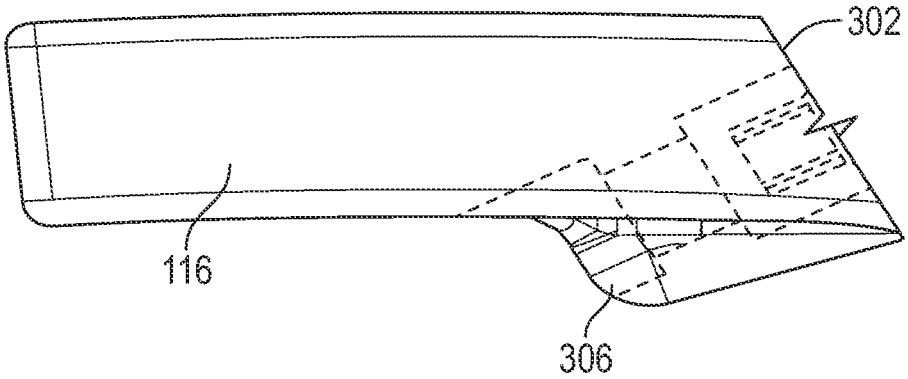
FIG. 8A is a side view of an example handle knob of the handle linkage shown in FIG. 2.
Figure 8B:
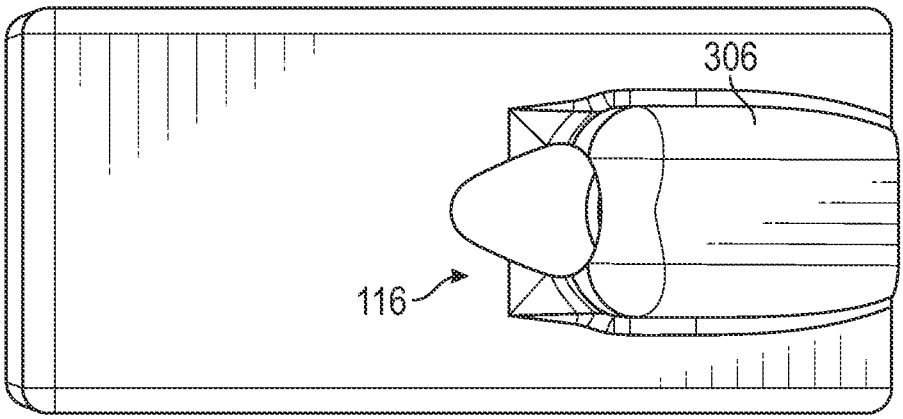
FIG. 8B is a bottom view of the example handle knob of the handle linkage shown in FIG. 2.

FIGS. 8A, B show side and bottom views of one example of the handle knob 116. As previously described the handle knob includes a knob interface 302 configured to rotate along an opposed arm interface 304 of the handle arm 114. The linkage guide 306, in this example, projects from a portion of the handle knob 116 and is configured for reception within the guide socket 400 of the escutcheon 104, shown in FIG. 5. Optionally, the linkage guide 306 and the guide socket 400 are reversed, for instance with the socket provided on the handle knob 116 (or arm 114) and the guide extending from the escutcheon 104. The linkage guide 306 and the guide socket 400 cooperate to guide or bias the handle linkage 102 into the aligned orientation of the stowed configuration, for instance as the linkage 102 is seated along the escutcheon seat 122 (see FIG. 5). The coupling of the linkage guide 306 within the guide socket 400 of the escutcheon 104 rotates the handle linkage 102 to complete the alignment of the linkage (if not already aligned). In another example, the linkage guide 306 and the guide socket 400 cooperate with the one or more bias elements 508, 602 described herein to enhance biasing and guidance of the handle linkage 102 to the aligned orientation and to maintain the linkage in the stowed orientation (aligned) until manipulation by a user.

Figure 9:
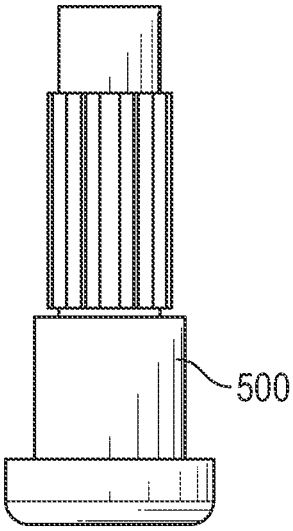
FIG. 9 is a side view of an example linkage pin of the handle linkage shown in FIG. 2.

FIG. 9 is a detailed side view of one example of the linkage pin 500 configured for reception within the pin socket 604 of the handle arm 114 and the pin recess 505 of the handle knob 116. The linkage pin 500 is aligned with the linkage pin axis 510 and accordingly facilitates rotation of the handle knob 116 from the aligned orientation shown in FIGS. 2 and 4 to the angled orientation of the operating configuration shown, for instance, in FIGS. 10A-10D.

Figure 10A:
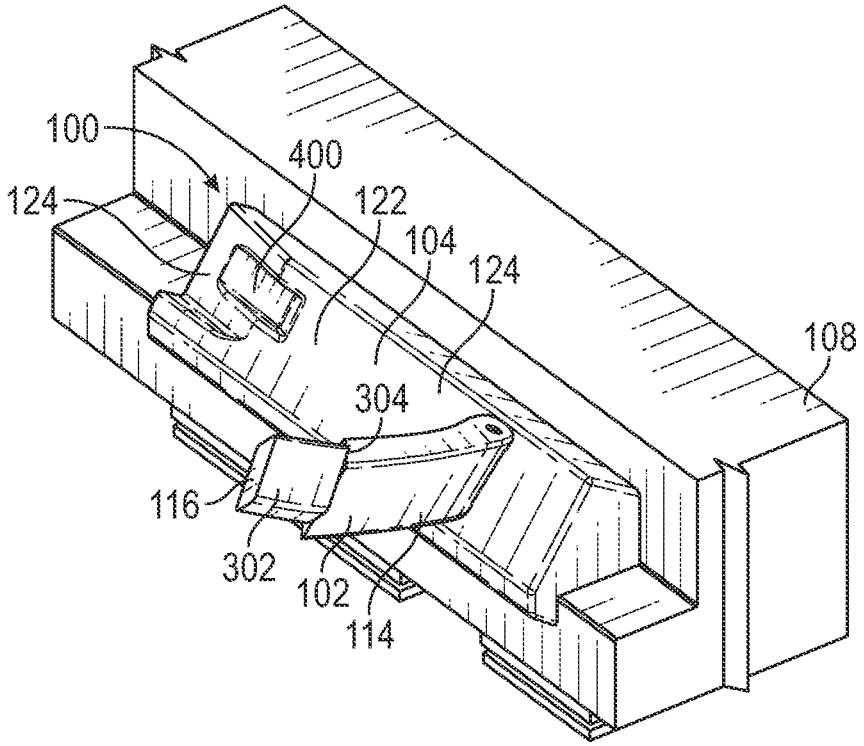
FIGS. 10A-10D are perspective views of the operator assembly shown in FIG. 2 in orientations of an operational configuration.

FIGS. 10A-10D are series of views of the example handle linkage 102 in the operating configuration and rotated around the drive socket 300 for actuation of the fenestration panel 110 with the operator mechanism 113 (see FIG. 1). Referring first to FIG. 10A, the operator assembly 100 is coupled with a portion of the fenestration frame 108. As shown, the handle linkage 102 is rotated away from the previously seated position (in the stowed configuration) and into the operating configuration. In one example, manipulation by the operator to pull the handle linkage 102 away from the seated position along the escutcheon seat 122 transitions the handle linkage 102 toward the operating configuration.

Additionally, the handle knob 116 is rotated into an angled orientation relative to the handle arm 114. For example, the handle knob 116 is rotated into a misaligned orientation relative to the aligned orientation of the stowed configuration shown in FIG. 2. Manipulation of the handle linkage 102 by the operator overcomes bias configured to retain the handle knob 116 aligned with the handle arm 114. Grasping of the handle knob 116 and rotation (e.g., by hand) moves the knob 116 into the misaligned orientation shown.

Figure 10B:
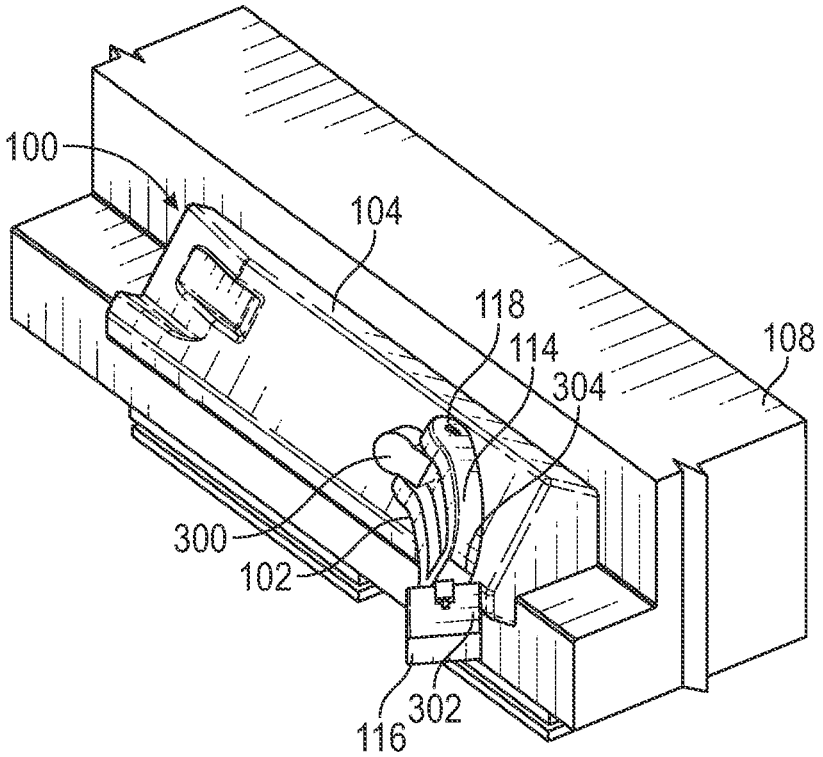
Figure 10C:
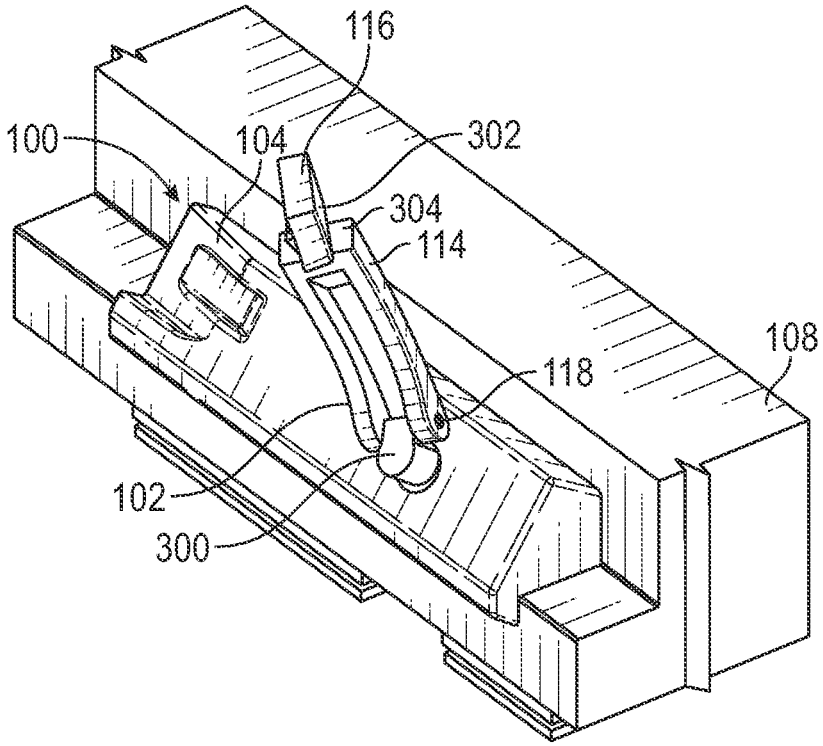
Figure 10D:
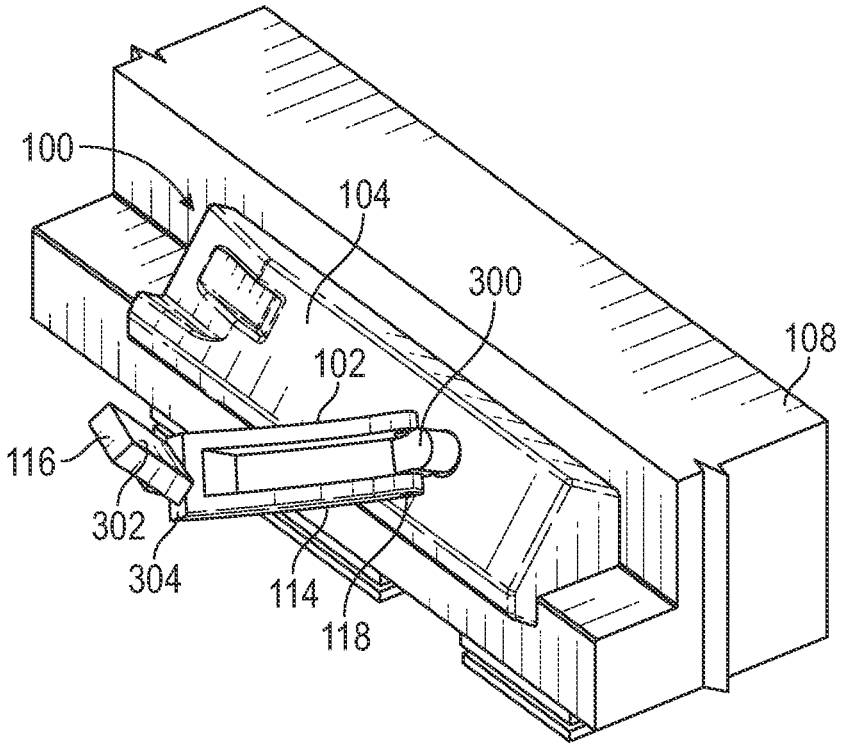

In FIG. 10A, the handle linkage 102 is shown in a first orientation of the operating configuration. FIGS. 10B-D show additional orientations of the handle linkage 102, for instance, as the handle linkage 102 is rotated in the manner of a crank to move the panel 110 of the fenestration assembly 106. The handle and knob interfaces 304, 302 cooperate at the articulated joint along with the angled linkage pin 500 (see FIG. 6) to guide rotation of the handle knob 116 as the linkage 102 is rotated. As shown in FIGS. 10A-10D the handle knob 116 remains in an angled orientation during operation of the handle linkage 102. The handle linkage 102 accordingly operates in the manner of a crank to rotate the drive sprocket 300 and the associated operator mechanism 113. The user operates the handle linkage 102 until a desired position of the panel 110 (e.g., closed, open, intermediate positions or the like) is achieved.

When operation of the handle linkage 102 is no longer specified the user readily stores the handle linkage 102 along the escutcheon 104 in a compact, low profile manner as described herein. For example, the handle knob 116 is rotated into or near to alignment with the handle arm 114. The handle linkage 102 is then rotated, for instance around one or more of the drive socket 300 or the handle pivot 118 (e.g., with one or more corresponding degrees of freedom) toward the escutcheon seat 122 of the escutcheon 104. The handle linkage 102 is coupled along the escutcheon seat 122, for instance with the handle linkage profile 126 coupling along the seat profile 124. As shown in FIG. 2, because the handle knob 116 and the handle arm 114 are aligned through rotation at the articulating joint 132 the handle linkage 102 has a relatively shallow profile, and the corresponding operator profile 130 is proximate to the fenestration profile 128 of the nearby portion of the fenestration frame 108. Accordingly, the operating assembly 100 generally follows the contour of the fenestration frame 108 and blends with the frame 108 until operation of the fenestration assembly 106 is needed.

Various Notes and Aspects

Aspect 1 can include subject matter such as a fenestration assembly comprising: an escutcheon configured for coupling with the fenestration assembly; a handle linkage coupled with the escutcheon and rotatable relative to the escutcheon, the handle linkage includes: a handle arm rotatably coupled with the escutcheon; a handle knob rotatably coupled with the handle arm; and an articulating joint between the handle arm and the handle knob; and wherein the handle linkage is movable between stowed and operational configurations: in the stowed configuration the handle linkage is seated along the escutcheon, and the handle arm and the handle knob are aligned; in the operational configuration the handle linkage is unseated from the escutcheon, the handle knob and the handle arm are misaligned with the handle knob at an operating angle relative to the handle arm, and the handle linkage is configured to open and close a fenestration panel.

Aspect 2 can include, or can optionally be combined with the subject matter of Aspect 1, to optionally include wherein the articulating joint includes: a linkage pin coupled between the handle knob and the handle arm; and the linkage pin is at the operating angle relative to the handle arm.

Aspect 3 can include, or can optionally be combined with the subject matter of one or any combination of Aspects 1 or 2 to optionally include wherein the articulating joint includes: a knob interface of the handle knob; and an arm interface of the handle arm, and the arm and knob interfaces are in sliding surface to surface contact.

Aspect 4 can include, or can optionally be combined with the subject matter of one or any combination of Aspects 1-3 to optionally include wherein the articulating joint includes a linkage pin, and the knob and arm interfaces are transverse to a linkage pin axis of the linkage pin.

Aspect 5 can include, or can optionally be combined with the subject matter of one or any combination of Aspects 1-4 to optionally include wherein the knob and arm interfaces are transverse to the linkage pin axis in each of the stowed and operational configurations.

Aspect 6 can include, or can optionally be combined with the subject matter of Aspects 1-5 to optionally include wherein at least one of the handle knob or the handle arm includes a first bias element, and the other of the handle arm or the handle knob includes a second bias element; and the first and second bias elements are configured to guide the handle knob and handle arm into alignment with transition from the operational configuration to the stowed configuration.

Aspect 7 can include, or can optionally be combined with the subject matter of Aspects 1-6 to optionally include wherein the first bias element includes a magnet bias element, and the second bias element includes one or more of an oppositely poled magnet bias element or a ferrous bias element.

Aspect 8 can include, or can optionally be combined with the subject matter of Aspects 1-7 to optionally include a drive socket configured for coupling with a fenestration operator mechanism, and the handle linkage includes a handle pivot pivotally coupling the handle arm with the drive socket.

Aspect 9 can include, or can optionally be combined with the subject matter of Aspects 1-8 to optionally include a fenestration frame; a fenestration panel rotatably coupled with the fenestration frame; and a fenestration operator mechanism coupled between the fenestration frame and the fenestration panel, wherein the handle linkage is coupled with the fenestration operator mechanism.

Aspect 10 can include, or can optionally be combined with the subject matter of Aspects 1-9 to optionally include a fenestration assembly comprising: an escutcheon having a first guide element; a handle linkage coupled with the escutcheon and rotatable relative to the escutcheon, the handle linkage includes: a handle arm rotatably coupled with the escutcheon; a handle knob rotatably coupled with the handle arm; an articulating joint between the handle arm and the handle knob; and one or more of the handle arm or the handle knob includes a second guide element complementary to the first guide element; and wherein the handle linkage is movable between operational and stowed configurations: in the operational configuration the handle knob and the handle arm are misaligned and the handle linkage is configured to open and close a fenestration panel; in the stowed configuration the handle arm and the handle knob are aligned and the handle linkage is seated along the escutcheon; and in an intermediate configuration the first and second guide elements are engaged and configured to guide the handle knob and the handle arm into alignment and seating along the escutcheon.

Aspect 11 can include, or can optionally be combined with the subject matter of Aspects 1-10 to optionally include wherein the second guide element includes a linkage guide extending from the handle linkage, and the first guide element includes a guide socket configured for reception of the linkage guide.

Aspect 12 can include, or can optionally be combined with the subject matter of Aspects 1-11 to optionally include wherein the guide socket includes a tapered profile configured to guide reception of the linkage guide.

Aspect 13 can include, or can optionally be combined with the subject matter of Aspects 1-12 to optionally include wherein the escutcheon includes an escutcheon seat having a seat profile having a first planar contour, and the handle linkage includes a handle linkage profile having a second planar contour complementary to the seat profile.

Aspect 14 can include, or can optionally be combined with the subject matter of Aspects 1-13 to optionally include wherein the second planar contour of the handle linkage profile in the stowed configuration is a continuous planar curve from the handle arm to the handle knob.

Aspect 15 can include, or can optionally be combined with the subject matter of Aspects 1-14 to optionally include wherein first planar contour of the seat profile is a planar curve proximate to the first guide element.

Aspect 16 can include, or can optionally be combined with the subject matter of Aspects 1-15 to optionally include wherein an operator assembly including the handle linkage and the escutcheon includes an operator profile including the seat profile and the handle linkage profile; and the operator profile corresponds to a fenestration profile of a fenestration frame.

Aspect 17 can include, or can optionally be combined with the subject matter of Aspects 1-16 to optionally include wherein in the operational configuration the handle linkage is spaced from the escutcheon, and the handle knob is at an operating angle relative to the handle arm.

Aspect 18 can include, or can optionally be combined with the subject matter of Aspects 1-17 to optionally include wherein the articulating joint includes a linkage pin having a linkage pin axis, and the handle knob is misaligned relative to the handle arm in the operational configuration based on the angle of the linkage pin axis relative to the handle arm.

Aspect 19 can include, or can optionally be combined with the subject matter of Aspects 1-18 to optionally include wherein at least one of the handle knob or the handle arm includes a first bias element, and the other of the handle arm or the handle knob includes a second bias element; and the first and second bias elements are configured to guide the handle knob and handle arm into alignment in the intermediate configuration.

Aspect 20 can include, or can optionally be combined with the subject matter of Aspects 1-19 to optionally include a fenestration frame; a fenestration panel rotatably coupled with the fenestration frame; and a fenestration operator mechanism coupled between the fenestration frame and the fenestration panel, wherein the handle linkage is coupled with the fenestration operator mechanism.

Aspect 21 can include, or can optionally be combined with the subject matter of Aspects 1-20 to optionally include a method for operating a fenestration assembly comprising: moving a fenestration panel of the fenestration assembly, opening the fenestration panel includes: rotating a handle linkage coupled with a fenestration operator mechanism, the handle linkage includes a handle knob rotatable at an operating angle relative to a handle arm; and moving the fenestration panel with the fenestration operator mechanism; and stowing the handle linkage along an escutcheon, stowing includes: aligning the handle knob with the handle arm at a stowed angle different than the operating angle; and seating the aligned handle linkage along the escutcheon.

Aspect 22 can include, or can optionally be combined with the subject matter of Aspects 1-21 to optionally include wherein a handle linkage profile of the handle knob and the handle arm is an elbowed profile while moving the fenestration panel; and the handle linkage profile of the handle knob and the handle arm is a linear profile while stowing the handle linkage.

Aspect 23 can include, or can optionally be combined with the subject matter of Aspects 1-22 to optionally include wherein aligning the handle knob with the handle arm includes rotating the handle knob at an articulating joint between the handle knob and the handle arm.

Aspect 24 can include, or can optionally be combined with the subject matter of Aspects 1-23 to optionally include wherein aligning the handle knob with the handle arm includes rotating the handle knob around a linkage pin oriented at the operating angle.

Aspect 25 can include, or can optionally be combined with the subject matter of Aspects 1-24 to optionally include wherein aligning the handle knob with the handle arm includes biasing the handle knob into alignment with biasing elements associated with one or more of the handle knob or the handle arm.

Aspect 26 can include, or can optionally be combined with the subject matter of Aspects 1-25 to optionally include aligning the handle knob with the handle arm includes: engaging a first guide element of the escutcheon with a second guide element of the handle linkage; and guiding the handle knob and the handle arm into alignment based on the engagement between the first and second guide elements.

Aspect 27 can include, or can optionally be combined with the subject matter of Aspects 1-26 to optionally include wherein the first guide element includes a guide socket of the escutcheon seat, and the second guide element includes a linkage guide of the handle linkage; and engaging the first guide element with the second guide element includes receiving the linkage guide of the handle linkage in the guide socket of the escutcheon.

Each of these non-limiting aspects can stand on its own, or can be combined in various permutations or combinations with one or more of the other aspects. The above description includes references to the accompanying drawings, which form a part of the detailed description. The drawings show, by way of illustration, specific embodiments in which the invention can be practiced. These embodiments are also referred to herein as "aspects" or "examples." Such aspects or example can include elements in addition to those shown or described. However, the present inventors also contemplate aspects or examples in which only those elements shown or described are provided. Moreover, the present inventors also contemplate aspects or examples using any combination or permutation of those elements shown or described (or one or more features thereof), either with respect to a particular aspects or examples (or one or more features thereof), or with respect to other Aspects (or one or more features thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

The above description is intended to be illustrative, and not restrictive. For example, the above-described aspects or examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as aspects, examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A fenestration assembly comprising:

an escutcheon configured for coupling with the fenestration assembly;

a handle linkage coupled with the escutcheon and rotatable relative to the escutcheon, the handle linkage includes:

a handle arm rotatably coupled with the escutcheon;

a handle knob rotatably coupled with the handle arm;

an articulating joint between the handle arm and the handle knob, the articulating joint having a static linkage pin axis transverse to the handle arm; and wherein at least one of the handle knob or the handle arm includes a first bias element, and the other of the handle arm or the handle knob includes a second bias element; and wherein the handle linkage is movable between stowed and operational configurations:

in the stowed configuration the handle linkage is seated along the escutcheon, the handle arm and the handle knob are aligned;

in the operational configuration the handle linkage is unseated from the escutcheon, the handle knob and the handle arm are misaligned and the handle knob is at an operating angle relative to the handle arm with articulation of the handle linkage around the static linkage pin axis, and the handle linkage is configured to open and close a fenestration panel with articulation of the handle linkage around the static linkage pin axis; and the first and second bias elements are configured to guide the handle knob and handle arm into alignment with transition from the operational configuration to the stowed configuration.

2. The fenestration assembly of claim 1, wherein the articulating joint includes:

a linkage pin coupled between the handle knob and the handle arm; and the linkage pin is at the operating angle relative to the handle arm.

3. The fenestration assembly of claim 1, wherein the articulating joint includes:

a knob interface of the handle knob; and an arm interface of the handle arm, and the arm and knob interfaces are in sliding surface to surface contact.

4. The fenestration assembly of claim 3, wherein the articulating joint includes a linkage pin, and the knob and arm interfaces are transverse to the static linkage pin axis of the linkage pin.

5. The fenestration assembly of claim 4, wherein the knob and arm interfaces are transverse to the static linkage pin axis in each of the stowed and operational configurations.

6. The fenestration assembly of claim 1, wherein the first bias element includes a magnet bias element, and the second bias element includes one or more of an oppositely poled magnet bias element or a ferrous bias element.

7. The fenestration assembly of claim 1 comprising a drive socket configured for coupling with a fenestration operator mechanism, and the handle linkage includes a handle pivot pivotally coupling the handle arm with the drive socket.

8. The fenestration assembly of claim 1 comprising:

a fenestration frame;

a fenestration panel rotatably coupled with the fenestration frame; and a fenestration operator mechanism coupled between the fenestration frame and the fenestration panel, wherein the handle linkage is coupled with the fenestration operator mechanism.

9. A fenestration assembly comprising:

an escutcheon having a first guide element;

a handle linkage coupled with the escutcheon and rotatable relative to the escutcheon, the handle linkage includes:

a handle arm rotatably coupled with the escutcheon;

a handle knob rotatably coupled with the handle arm;

a rotating articulating joint between the handle arm and the handle knob, the articulating joint having a static linkage pin axis transverse to the handle arm;

one or more of the handle arm or the handle knob includes a second guide element complementary to the first guide element; and wherein at least one of the handle knob or the handle arm includes a first bias element, and the other of the handle arm or the handle knob includes a second bias element; and wherein the handle linkage is movable between operational and stowed configurations:

in the operational configuration the handle knob and the handle arm are misaligned and the handle linkage is configured to open and close a fenestration panel based on rotation of the handle knob around the static linkage pin axis;

in the stowed configuration the handle arm and the handle knob are aligned end to end based on rotation of the handle knob around the static linkage pin axis, the handle linkage is seated along the escutcheon, and the handle linkage is longer than in the operational configuration; and in an intermediate configuration the first and second guide elements are coupled and configured to guide the handle knob and the handle arm into alignment and seating along the escutcheon, and the first and second bias elements are configured to guide the handle knob and handle arm into alignment.

10. The fenestration assembly of claim 9, wherein the second guide element includes a linkage guide extending from the handle linkage, and the first guide element includes a guide socket configured for reception of the linkage guide.

11. The fenestration assembly of claim 10, wherein the guide socket includes a tapered profile configured to guide reception of the linkage guide.

12. The fenestration assembly of claim 9, wherein the escutcheon includes an escutcheon seat having a seat profile having a first planar contour, and the handle linkage includes a handle linkage profile having a second planar contour complementary to the seat profile.

13. The fenestration assembly of claim 12, wherein the second planar contour of the handle linkage profile in the stowed configuration is a continuous planar curve from the handle arm to the handle knob.

14. The fenestration assembly of claim 12, wherein first planar contour of the seat profile is a planar curve proximate to the first guide element.

15. The fenestration assembly of claim 12, wherein an operator assembly including the handle linkage and the escutcheon includes an operator profile including the seat profile and the handle linkage profile; and the operator profile corresponds to a fenestration profile of a fenestration frame.

16. The fenestration assembly of claim 9, wherein in the operational configuration the handle linkage is spaced from the escutcheon, and the handle knob is at an operating angle relative to the handle arm.

17. The fenestration assembly of claim 9, wherein the articulating joint includes a linkage pin having the static linkage pin axis, and the handle knob is misaligned relative to the handle arm in the operational configuration based on the angle of the linkage pin axis relative to the handle arm.

18. The fenestration assembly of claim 9, comprising:

a fenestration frame;

a fenestration panel rotatably coupled with the fenestration frame; and a fenestration operator mechanism coupled between the fenestration frame and the fenestration panel, wherein the handle linkage is coupled with the fenestration operator mechanism.

19. A method for operating a fenestration assembly comprising:

moving a fenestration panel of the fenestration assembly with a handle linkage in an operational configuration, moving the fenestration panel includes:

rotating the handle linkage coupled with a fenestration operator mechanism, rotating the handle linkage includes rotating a handle knob with an articulating joint around a static linkage pin axis transverse to a handle arm in the operational configuration, the handle knob and the handle arm are misaligned and the handle knob is at an operating angle relative to the handle arm; and moving the fenestration panel with the fenestration operator mechanism; and stowing the handle linkage along an escutcheon in a stowed configuration, stowing includes:

guiding the handle knob and handle arm toward alignment in the stowed configuration with first and second bias elements associated with the handle arm and the handle knob, respectively;

aligning the handle knob with the handle arm by rotating of the handle knob around the static linkage pin axis, the handle linkage having a greater length in the stowed configuration than in the operational configuration; and seating the aligned handle linkage along the escutcheon.

20. The method of claim 19, wherein a handle linkage profile of the handle knob and the handle arm is an elbowed profile while moving the fenestration panel; and the handle linkage profile of the handle knob and the handle arm is a linear profile while stowing the handle linkage.

21. The method of claim 19, wherein aligning the handle knob with the handle arm includes rotating the handle knob around a linkage pin oriented at the operating angle.

22. The method of claim 19, aligning the handle knob with the handle arm includes:

engaging a first guide element of the escutcheon with a second guide element of the handle linkage; and guiding the handle knob and the handle arm into alignment based on the engagement between the first and second guide elements.

23. The method of claim 22, wherein the first guide element includes a guide socket of the escutcheon seat, and the second guide element includes a linkage guide of the handle linkage; and engaging the first guide element with the second guide element includes receiving the linkage guide of the handle linkage in the guide socket of the escutcheon.

* * * * *